US009455517B2

(12) United States Patent
Babu et al.

(10) Patent No.: US 9,455,517 B2
(45) Date of Patent: Sep. 27, 2016

(54) COMMUNICATION CONNECTOR HAVING PLUG INTERFACE CONTACTS OF VARYING THICKNESS AND/OR MULTIPLE LAYERS

(71) Applicant: Panduit Corp., Tinley Park, IL (US)

(72) Inventors: Surendra Chitti Babu, New Lenox, IL (US); Satish I. Patel, Roselle, IL (US); Robert E. Fransen, Tinley Park, IL (US)

(73) Assignee: Panduit Corp., Tinley Park, IL (US)

( * ) Notice: Subject to any disclaimer, the term of this patent is extended or adjusted under 35 U.S.C. 154(b) by 0 days.

(21) Appl. No.: 14/802,123

(22) Filed: Jul. 17, 2015

(65) Prior Publication Data

US 2015/0325965 A1 Nov. 12, 2015

Related U.S. Application Data

(63) Continuation of application No. 14/186,697, filed on Feb. 21, 2014, now Pat. No. 9,118,134.

(60) Provisional application No. 61/771,600, filed on Mar. 1, 2013.

(51) Int. Cl.

| | |
|---|---|
| ***H01R 13/64*** | (2006.01) |
| ***H01R 13/26*** | (2006.01) |
| ***H01R 24/00*** | (2011.01) |

(Continued)

(52) U.S. Cl.

CPC ..... *H01R 13/26* (2013.01); *H01R 13/6461* (2013.01); *H01R 13/6474* (2013.01); *H01R 23/005* (2013.01); *H01R 24/64* (2013.01); *H01R 27/00* (2013.01); *H01R 2107/00* (2013.01)

(58) Field of Classification Search

CPC ..... H01R 13/26; H01R 13/6461; H01R 13/6474; H01R 23/005; H01R 24/64; H01R 27/00; H01R 2107/00

USPC ..... 439/676

See application file for complete search history.

(56) References Cited

U.S. PATENT DOCUMENTS 3,824,554 A * 7/1974 Shoholm ..... H01R 12/585 439/873
4,408,824 A * 10/1983 Weidler ..... H01R 4/2462 439/398

(Continued)

FOREIGN PATENT DOCUMENTS

EP 0969569 A2 1/2000

OTHER PUBLICATIONS

Photographs of Siemon Z6A-01 jack, Dec. 5, 2012.

*Primary Examiner* — Chandrika Prasad

(74) *Attorney, Agent, or Firm* — Christopher S. Clancy; James H. Williams; Yuri Astvatsaturov

(57) ABSTRACT

The present invention generally relates to communication connectors and internal components thereof. In one embodiment, the present invention is a communication jack comprising back-rotated plug interface contacts having variable cross-sectional widths. In another embodiment, the present invention is a communication jack having back-rotated plug interface contacts where at least two of the plug interface contacts have a differing beam length. In yet another embodiment, the present invention is a communication jack having back-rotated plug interface contacts where at least two of the plug interface contacts have opposing bends in a deflection zone.

20 Claims, 17 Drawing Sheets

(51) Int. Cl.

| | |
|---|---|
| ***H01R 13/6461*** | (2011.01) |
| ***H01R 13/6474*** | (2011.01) |
| ***H01R 24/64*** | (2011.01) |
| *H01R 107/00* | (2006.01) |
| *H01R 27/00* | (2006.01) |

(56) References Cited

U.S. PATENT DOCUMENTS 4,691,979 A * 9/1987 Manska ..... H01R 12/585 439/82
4,795,379 A * 1/1989 Sasaki ..... H01R 13/11 439/856
4,936,797 A * 6/1990 Wehrle ..... H01R 43/16 439/751
5,131,874 A * 7/1992 Seido ..... H01R 43/16 439/636
5,565,654 A * 10/1996 Zell ..... H01R 12/523 174/262
6,017,229 A 1/2000 Tulley et al.
7,708,603 B1 5/2010 Little
7,850,492 B1 * 12/2010 Straka ..... H01R 13/6625 439/676
9,118,134 B2 * 8/2015 Babu ..... H01R 13/26
2004/0092170 A1 5/2004 Colantuono et al.
2008/0254685 A1 10/2008 Murr et al.
2011/0136382 A1 6/2011 Jaouen et al.

* cited by examiner

COMMUNICATION CONNECTOR HAVING PLUG INTERFACE CONTACTS OF VARYING THICKNESS AND/OR MULTIPLE LAYERS

CROSS-REFERENCE TO RELATED APPLICATIONS

This application is a continuation of U.S. patent application Ser. No. 14/186,697, filed Feb. 21, 2014, which claims the benefit of U.S. Provisional Patent Application No. 61/771,600, filed Mar. 1, 2013, the subject matter of which is hereby incorporated by reference in its entirety.

FIELD OF INVENTION

The present invention generally relates to the field of communication connectors, and more specifically to plug interface contact arrangements, and communication jacks which employ such plug interface contact arrangements.

BACKGROUND

Communication connectors, such as RJ45 jacks, have been and continue to be readily employed in the communication industry. These jacks generally comprise a housing having an aperture for receiving a corresponding plug at one end, a means for terminating a communication cable at another end, and a means for transferring electrical signals between the plug and the communication cable.

In an RJ45 jack, the means for transferring the electrical signals typically include eight plug interface contacts (PICs). While the eight PICs are designed to interface eight plug contacts positioned in an eight-position RJ45 plug, respectively, it is also possible to connect a six-position plug (e.g., RJ12, RJ25) or a four-position plug (e.g., RJ9) to an RJ45 jack. However, when compared to an eight-position plug, plug contacts 1 and 8 do not exist in a six-position plug, and plug contacts 1, 2, 7, and 8 do not exist in a four-position plug. Therefore, in the locations where the plug contacts are not present, the jack PICs must deflect approximately an additional 0.027 inches as compared to locations where the plug contacts do exist. This additional deflection can cause the outer PICs to plastically deform and cause damage (or otherwise prevent operation within certain specifications) to the jack if the deformation is significant enough. Additionally, in some instances the positioning/arrangement of the PICs may have some effect on the amount of undesired crosstalk produced within the jack and/or how the undesired crosstalk is compensated for.

Thus there exists a need for communication jacks with improved designs.

SUMMARY

Accordingly, embodiments of the present invention are directed to communication connectors and/or internal components thereof.

In one embodiment, the present invention is a communication jack having back-rotated plug interface contacts where at least one plug interface contact has a non-uniform cross-sectional width.

In another embodiment, the present invention is a communication jack having back-rotated plug interface contacts where at least two of the plug interface contacts have a differing beam length.

In yet another embodiment, the present invention is a communication jack having back-rotated plug interface contacts where at least of the plug interface contacts have opposing bends in a deflection zone.

In still yet another embodiment, the present invention is a communication connector comprising a housing with an aperture for receiving a plug, and a plurality of plug interface contacts (PICs) at least partially received in the aperture. The plurality of plug interface contacts include respective ends proximal the aperture and ends distal the aperture, the distal ends fixed within the connector, the proximal ends rotating relative to the distal ends, wherein at least some of the plurality of plug interface contacts have a non-uniform cross-sectional width. In a variation of this embodiment, the connector is included in a communication system.

In still yet another embodiment, the present invention is a communication connector comprising a housing with an aperture for receiving a plug and a plurality of plug interface contacts (PICO at least partially received in the aperture. The plurality of plug interface contacts include respective ends proximal the aperture and respective ends distal the aperture, the distal ends fixed within the connector, the proximal ends rotating relative to the distal ends, the proximal ends configured, when the connector being mated to the plug, such that some of the proximal ends are deflected more than other of the proximal ends.

In still yet another embodiment, the present invention is a communication connector comprising a housing with an aperture for receiving a plug and a plurality of plug interface contacts (PICs) at least partially received in the aperture. The plurality of plug interface contacts include respective ends proximal the aperture and respective ends distal the aperture, the distal ends fixed within the connector, the proximal ends rotating relative to the distal ends, the distal end being hemmed.

These and other features, aspects, and advantages of the present invention will become better-understood with reference to the following drawings, description, and any claims that may follow.

DETAILED DESCRIPTION

Figure 1:
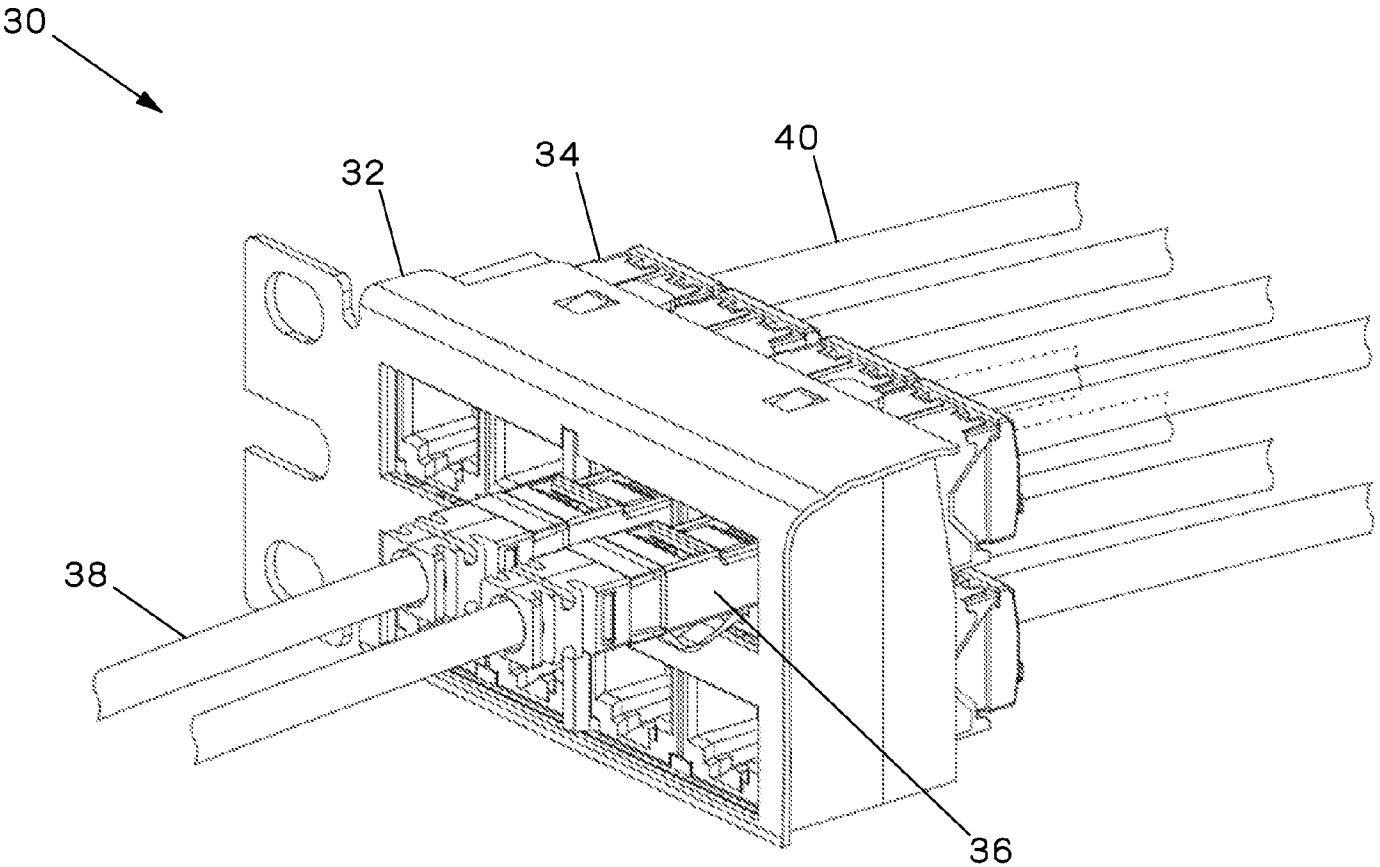
FIG. 1 illustrates a communication system according to an embodiment of the present invention.

An exemplary embodiment of the present invention is illustrated in FIG. 1, which shows a communication system 30, which includes a patch panel 32 with jacks 34 and corresponding RJ45 plugs 36. Respective cables 38 are terminated to plugs 36, and respective cables 40 are terminated to jacks 34. Once a plug 36 mates with a jack 34 data can flow in both directions through these connectors. Although the communication system 30 is illustrated in FIG. 1 as having a patch panel, alternative embodiments can include other active or passive equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers and or telecommunications rooms; security devices (cameras and other sensors, etc.) and door access equipment; and telephones, computers, fax machines, printers, and other peripherals as can be found in workstation areas. Communication system 30 can further include cabinets, racks, cable management and overhead routing systems, and other such equipment.

Figure 2:
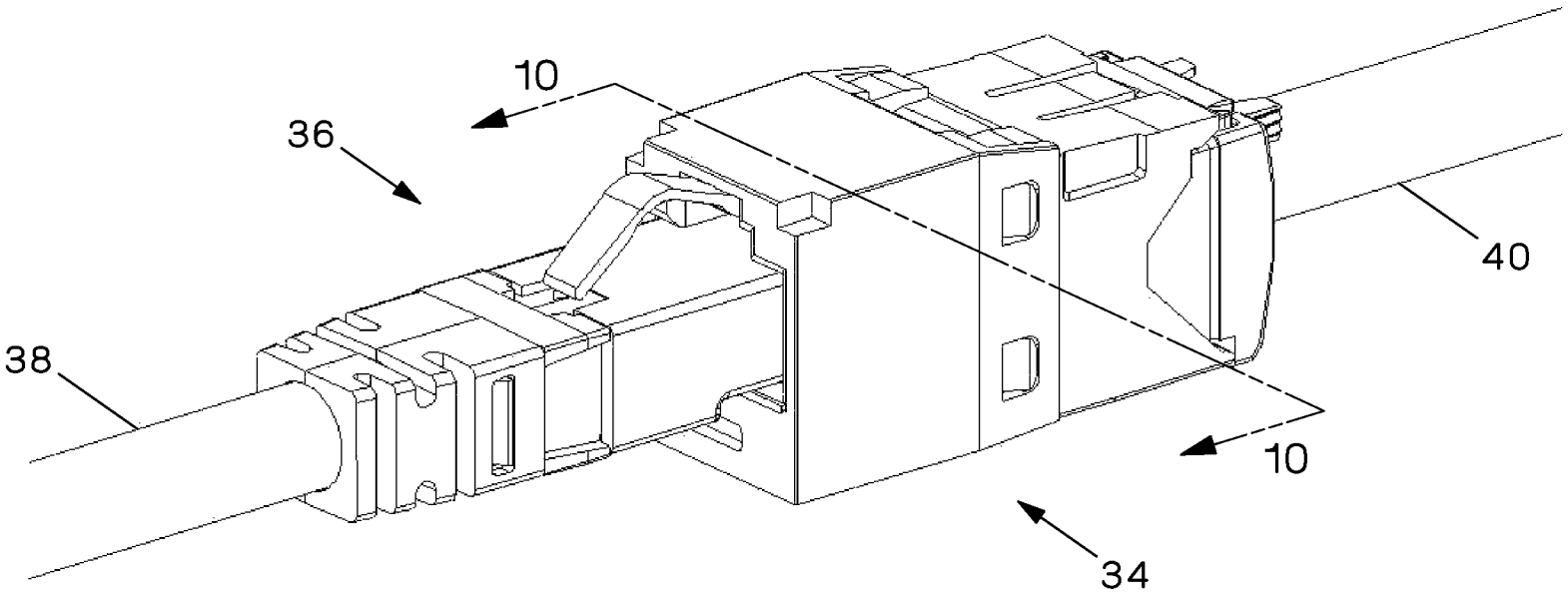
FIG. 2 illustrates a plug and jack combination according to an embodiment of the present invention.

The jack and plug combination of FIG. 1 is also shown in FIG. 2 which illustrates the network jack 34 mated with the RJ45 plug 36. Note that in this figure, the orientation of the network jack 34 and the RJ45 plug 36 is rotated 180° about the central axis of cable 40 as compared to the orientation of FIG. 1.

Figure 3:
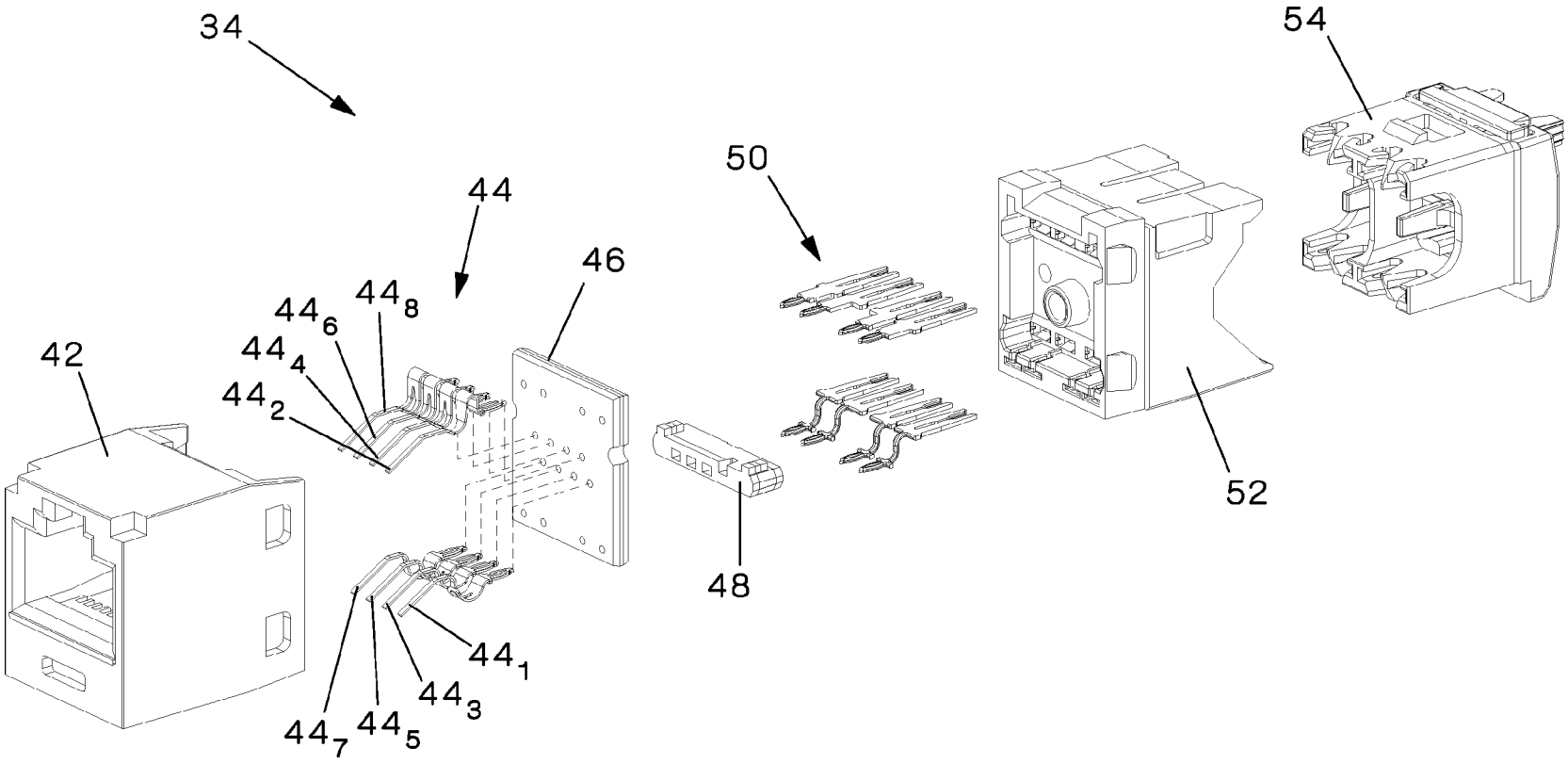
FIG. 3 illustrates an exploded view of a communication jack according to an embodiment of the present invention.
Figure 4:
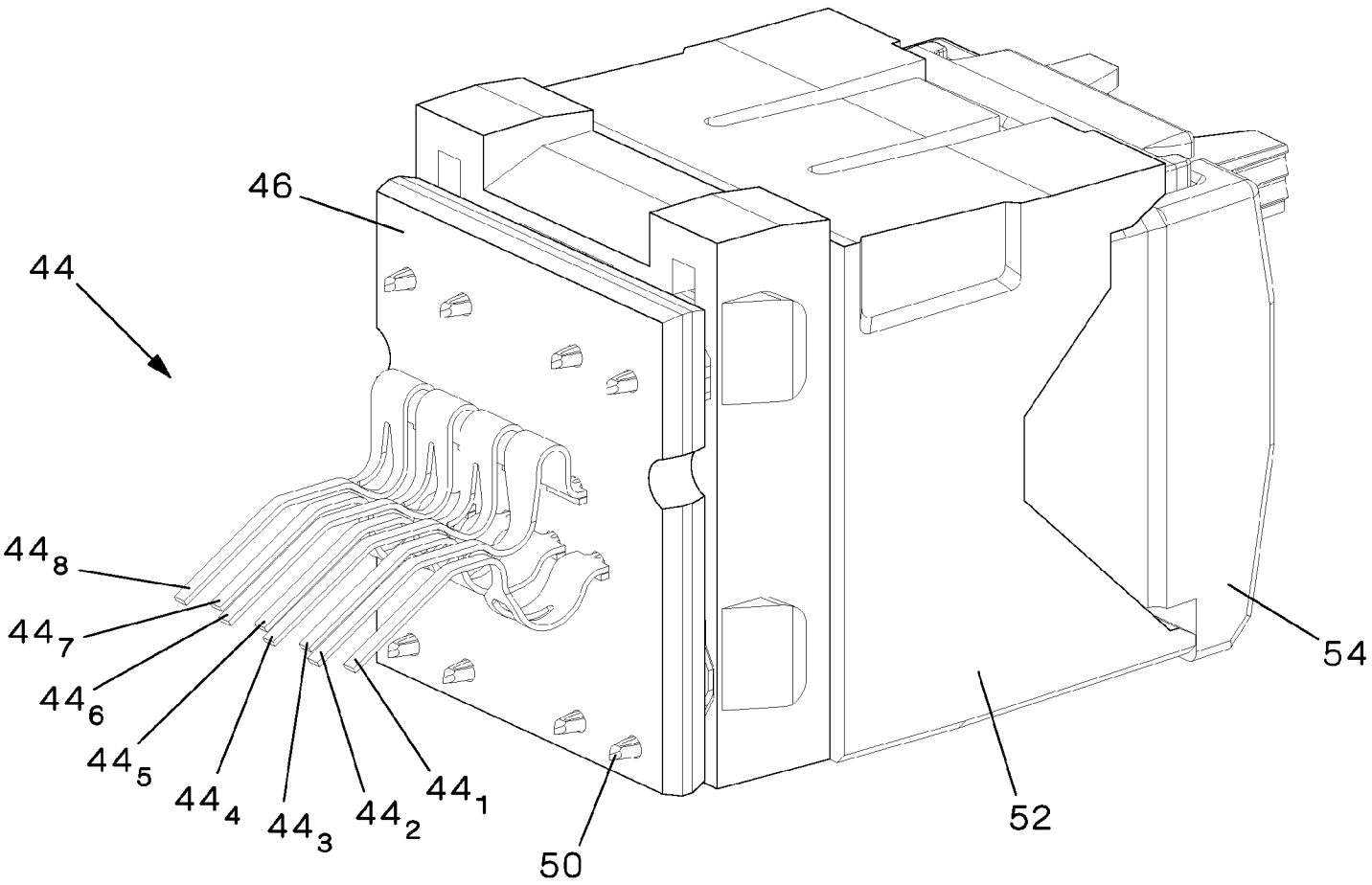
FIG. 4 illustrates the jack of FIG. 3 with the front housing removed.
Figure 5:
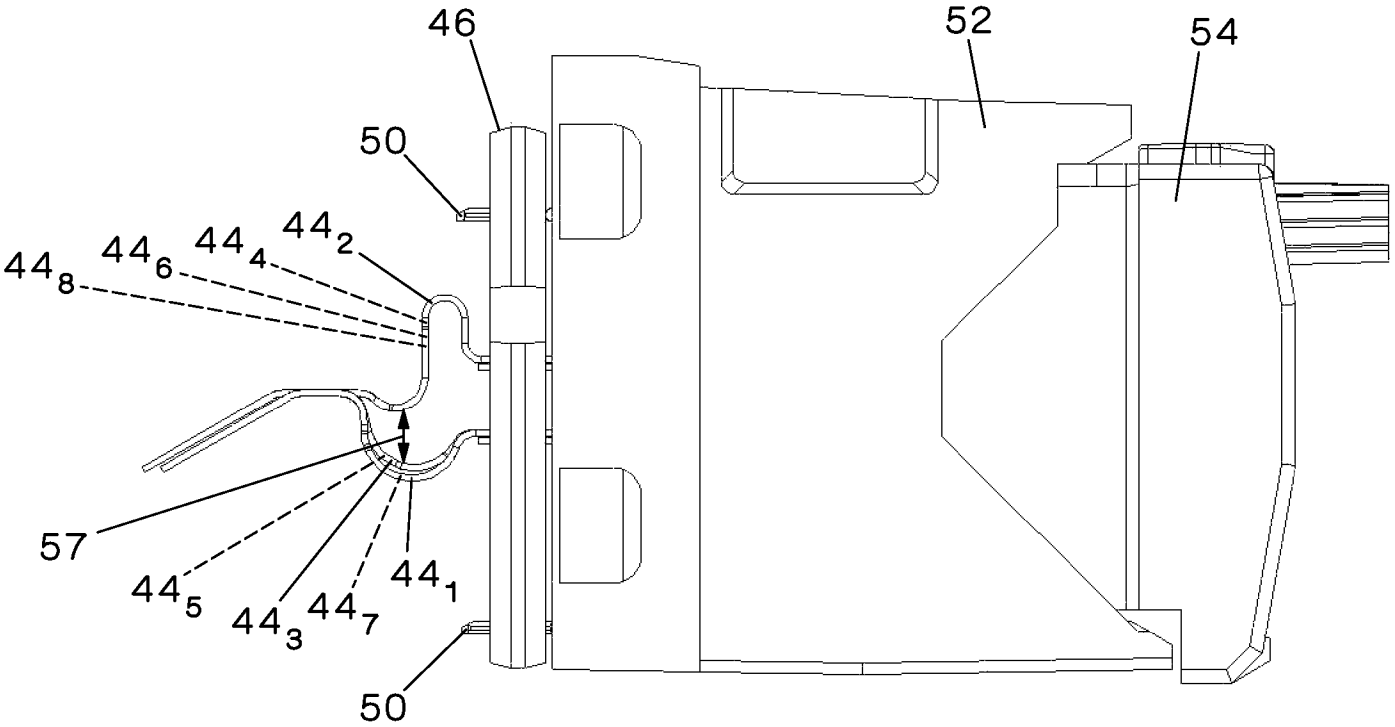
FIG. 5 illustrates a side view of the jack of FIG. 4.

FIG. 3 illustrates an exploded view of the network jack 34, which includes a front housing 42, plug interface contacts (PICs) 44, a printed circuit board (PCB) 46 (which in some embodiments may have crosstalk compensation components thereon), an insulation displacement contact (IDC) support 48, IDCs 50, a rear housing 52, and a wire cap 54. In the currently described embodiment, the PICs may be referred to as "back-rotated" which implies that the PICs are fixed at the (PCB) and generally flex about the location where each respective PIC connects to the PCB. FIG. 4 illustrates the assembled state of PICs 44 to PCB 46 of the network jack 34 with the front housing 42 removed for clarity. The subscript number for each PIC 44 corresponds to the RJ45 pin positions as defined by ANSI/TIA-568-C.2. A side view of FIG. 4 is depicted in FIG. 5, and PICs 44 are illustrated individually in FIG. 6.

Figure 6:
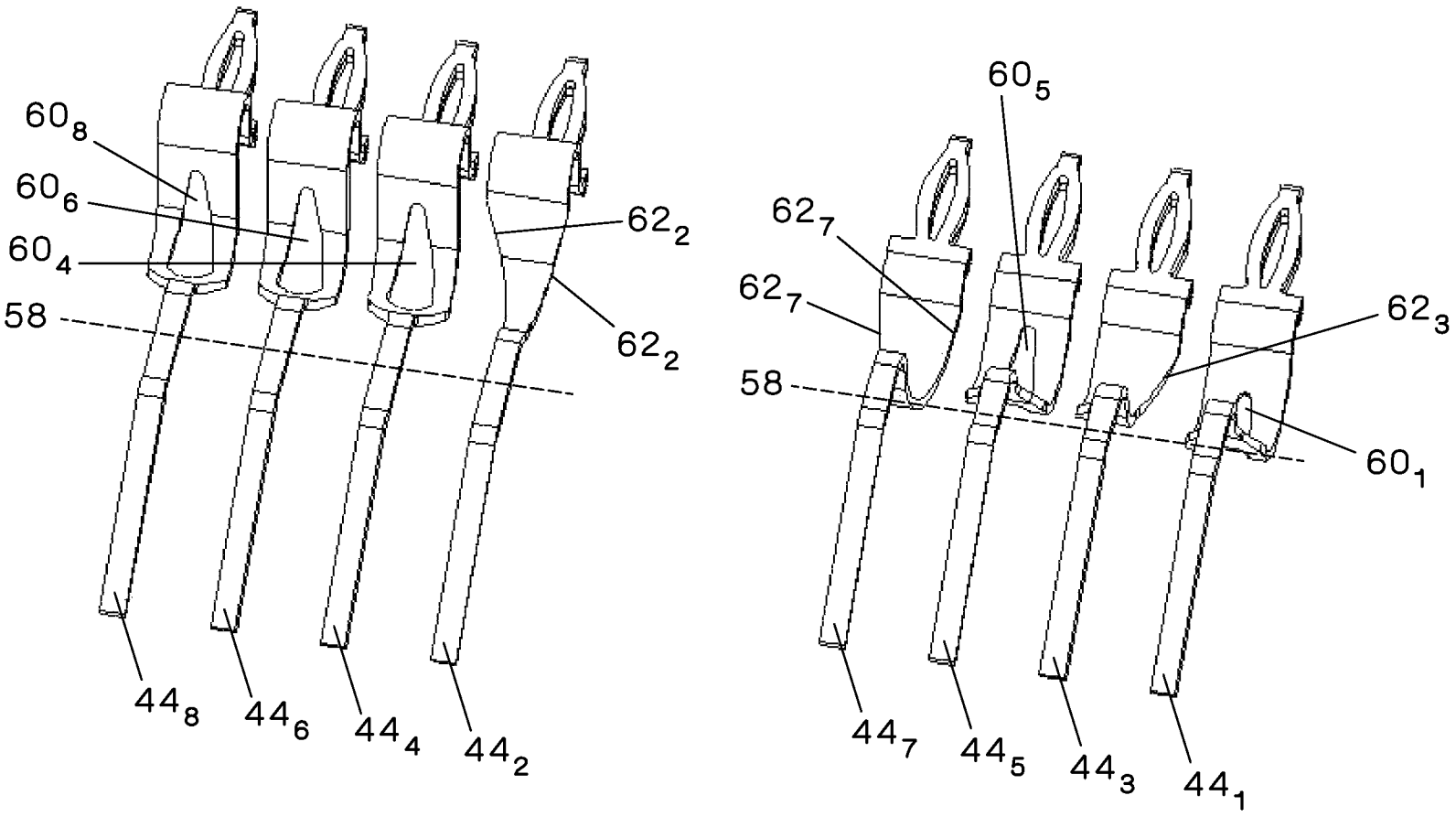
FIG. 6 illustrates the PICs of the jack from FIG. 3.
Figure 7A:
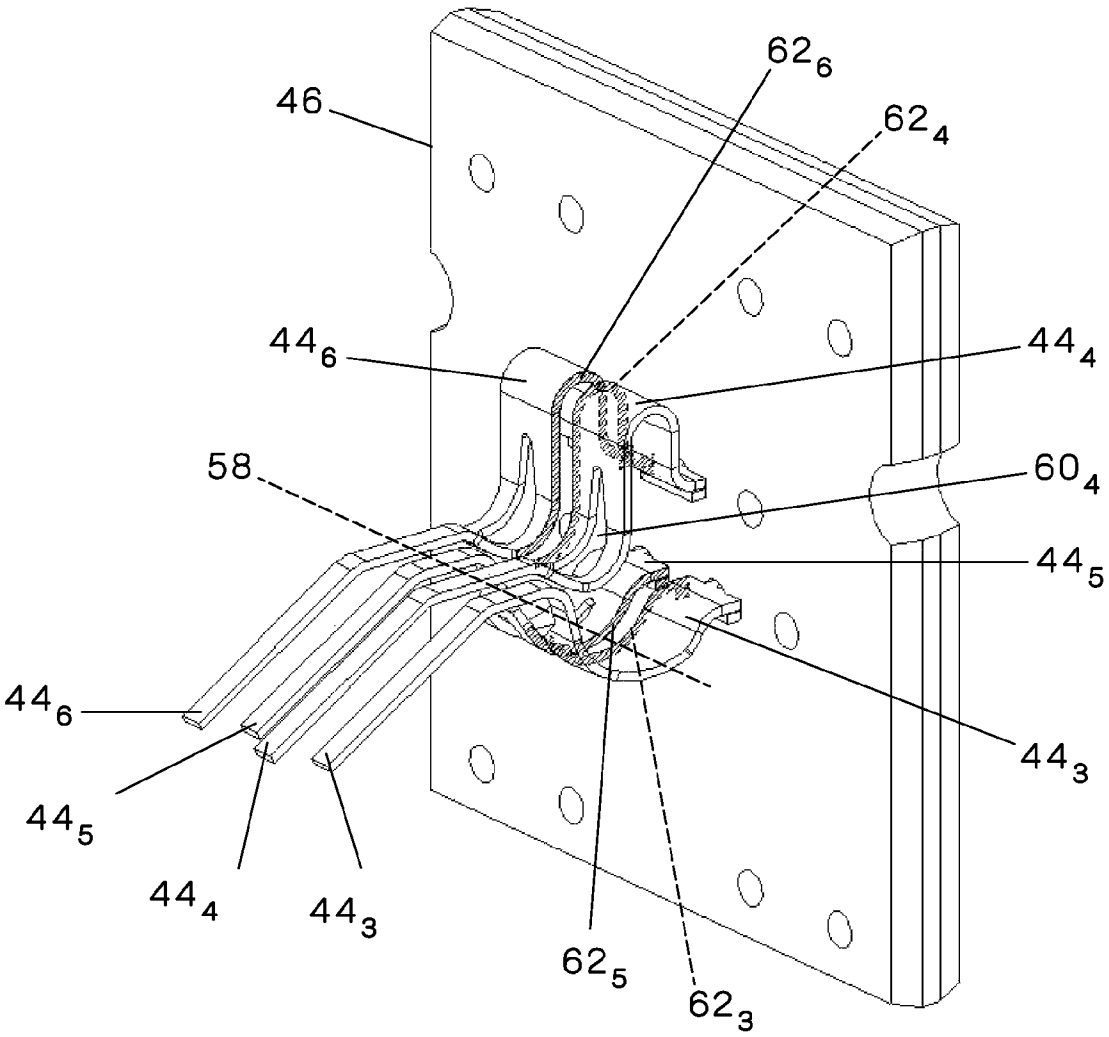
FIG. 7A illustrates some of the PICs assembled to the printed circuit board of the jack of FIG. 3.

As noted previously, when an RJ45 jack is mated with a six-position or a four-position plug, the outer PICs (PICs $\mathbf{44}_1$ and $\mathbf{44}_8$ for a six-position plug, and PICs $\mathbf{44}_1$, $\mathbf{44}_2$, $\mathbf{44}_7$, and $\mathbf{44}_8$ for a four-position plug) must be able to deflect an additional 0.027" over PICs $\mathbf{44}_3$, $\mathbf{44}_4$, $\mathbf{44}_5$, and $\mathbf{44}_6$, and have sufficient elasticity to return to an unloaded state once the six-position or the four-position plug is removed. This can help provide proper future functionality by ensuring that sufficient normal force exists to mate with all corresponding plug contact 56 of an RJ45 plug (see FIG. 10). In order to reduce at least some amount of plastic deformation of the PICs, it is beneficial to distribute the mechanical stresses over at least a significant portion of the deflection zone, which in the current embodiment spans between the plug contact zone 58 and the PCB 46 as shown in FIGS. 6 and 7A. This may avoid localized stress peaks and may result in an increased material yield.

One way of achieving a desired distribution of mechanical stress is by varying the width of the PICs. An example of this is shown in PIC $\mathbf{44}_4$, which has a pocket 604 which serves to assist in distributing stresses by varying the cross-sectional width of PIC $\mathbf{44}_4$. The cross-section is varied by adding more material to PIC $\mathbf{44}_4$ as the distance is increased from the plug contact zone 58. This effectively causes the stiffness of PIC $\mathbf{44}_4$ to increase as distance is increased from the plug contact zone 58, resulting in a distribution of stresses over an increased portion of the deflection zone. Although PIC $\mathbf{44}_4$ is shown as an example, this varying cross-section is also applied to the remaining PICs $\mathbf{44}_1$, $\mathbf{44}_2$, $\mathbf{44}_3$, $\mathbf{44}_5$, $\mathbf{44}_6$, $\mathbf{44}_7$, and $\mathbf{44}_8$. However, PICs $\mathbf{44}_2$, $\mathbf{44}_3$, and $\mathbf{44}_7$ vary their cross-sectional width by adjusting respective outer faces 62, while PICs $\mathbf{44}_1$, $\mathbf{44}_4$, $\mathbf{44}_5$, $\mathbf{44}_6$, and $\mathbf{44}_8$ vary their cross-sectional width with an internal pocket 60.

PICs 44 vary their cross-sectional widths differently in order to control the relative amount of crosstalk as well as account for their full range of deflection. For example, PICs $\mathbf{44}_1$, $\mathbf{44}_2$, $\mathbf{44}_7$, and $\mathbf{44}_8$ deflect more than PICs $\mathbf{44}_3$, $\mathbf{44}_4$, $\mathbf{44}_5$, and $\mathbf{44}_6$ if a four position plug is inserted. Such a difference in deflection may cause the distance between PICs $\mathbf{44}_2$ and $\mathbf{44}_3$, and $\mathbf{44}_6$ and $\mathbf{44}_7$ to become sufficiently small to cause a risk of an electrical short or a hipot failure. To reduce the potential of these risks, the cross sectional width of the PICs can be varied such that sufficient distance remains between adjacent PICs even in the event of varying levels of deflection. For example, referring to FIG. 6, one will notice that the outer face $\mathbf{62}_2$ of PIC $\mathbf{44}_2$ and the outer face $\mathbf{62}_3$ of PIC $\mathbf{44}_3$ are tapered towards the contact zone 58. Such tapering may increase the minimum distance between the respective PICs when these PICs are deflected differently.

In addition to a varying cross-sectional width, the PICs 44 employ different bend profiles. This can be seen in the side view of FIG. 5. PICs $\mathbf{44}_1$ and $\mathbf{44}_7$ have a first bend profile, PICs $\mathbf{44}_3$ and $\mathbf{44}_5$ have a second bend profile, and PICs $\mathbf{44}_2$, $\mathbf{44}_4$, $\mathbf{44}_6$, and $\mathbf{44}_8$ have a third bend profile. Because PICs $\mathbf{44}_1$ and $\mathbf{44}_7$ may deflect more than PICs $\mathbf{44}_3$ and $\mathbf{44}_5$ in the event of mating with four-position plug, PICs $\mathbf{44}_1$ and $\mathbf{44}_7$ have a longer deflection zone (than PICs $\mathbf{44}_3$ and $\mathbf{44}_5$) which may allow them to sustain additional deflection without plastic deformation.

In addition to having mechanical resiliency, in certain cases it may be important to focus on the electrical performance of the PIC arrangement. For example, compensating for the crosstalk that occurs between differential signal pairs 4:5 and 3:6 is typically more difficult to achieve because the plug pair combination 4:5-3:6 is required by the ANSI/TIA-568-C.2 standard to have the largest magnitude of crosstalk out of all pair combinations in the plug. The reason for this is that pair 4:5 runs between split pair 3:6 for a distance that starts in the RJ45 plug 36 and ends at the first compensation zone in the jack 34. Therefore, the ensuing discussion focuses on the ability of PICs 44 to assist in obtaining the desired electrical performance, particularly for signal pairs 4:5 and 3:6.

The capacitive and inductive coupling that occurs between signal line 3 and signal line 4 in the RJ45 plug 36 adds crosstalk between differential pair combinations 4:5 and 3:6. Similarly, the capacitive and inductive coupling that occurs between signal line 5 and signal line 6 also adds crosstalk between differential pair combinations 4:5 and 3:6. It is possible to reduce the negative effects of crosstalk via several ways. First, it is advantageous to reduce the initial amount of capacitive and inductive crosstalk coupling occurring between the 3:4 and 5:6 signal lines. This can be achieved by having PICs $44_3$ and $44_5$ bend down (relative to orientation shown in FIG. 7A) and having PICs $44_4$ and $44_6$ bend up between the plug contact zone 58 and the PCB 46. Because PIC $44_3$ bends down and PIC $44_4$ bends up, distance 57 (see FIG. 5) between the two PICs is increased, resulting in a decreased amount of crosstalk coupling. An equivalent relationship exists between PICs $44_5$ and $44_6$.

Figure 7B:
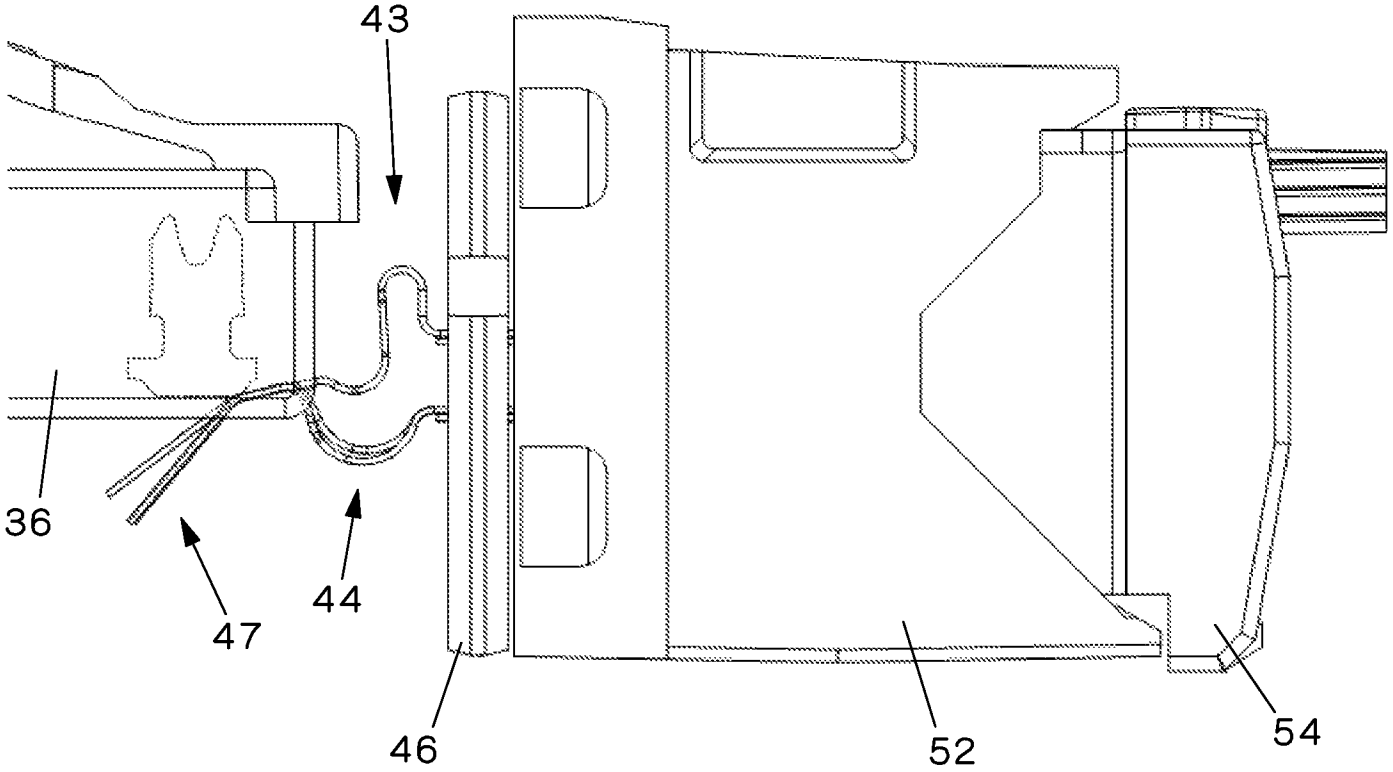
FIG. 7B illustrates a side view of the jack of FIG. 3 mated with a plug, with the front housing removed.

Another example of reducing the initial amount of crosstalk is illustrated in FIG. 7B where the network jack 34 (with front housing removed), is shown with PICs 44 having respective proximal ends 47 and distal ends 43. When a plug 36 is mated to the jack 34, some proximal ends 47 (e.g., corresponding to PICs $44_1$, $44_3$, $44_5$, and $44_7$) deflect more than other proximal ends 47 (e.g., corresponding to PICs $44_2$, $44_4$, $44_6$, and $44_8$). Consequently electrical coupling between adjacent PICs 44 can be reduced in the vicinity of proximal ends 47.

Second, it is advantageous to provide a compensation signal. To compensate for the offending crosstalk between the 3:4 and 5:6 pairs, compensative capacitive coupling is required between signal lines 3 and 5, and signal lines 4 and 6, respectively. The closer the compensative capacitive coupling is to the offending crosstalk (e.g., the RJ45 plug contacts 56) the more effective the compensation and therefore better performance may be attainable. At least some of the desired compensative capacitive coupling can be achieved by placing PICs $44_4$ and $44_5$ within a near proximity of PICs $44_6$ and $44_3$, respectively. The increase in the cross-sectional width in the deflection zone allows the outer face $62_4$ of PIC $44_4$ to be closer to outer face $62_6$ of PIC $44_6$ (shown crosshatched) than if PICs 44 were of uniform width. This relative closeness results in increased compensative capacitive coupling between signal lines 4 and 6. Similarly the increased width of PICs $44_3$ and $44_5$ results in increased compensative capacitive coupling between signal lines 3 and 5.

While additional compensation may be required to further reduce the offending crosstalk between signal lines 3:4 and 5:6 (this additional compensation can occur on PCB 46), the compensation provided by PICs 44 lessens the amount of compensation that may be needed on the PCB 46. It also brings the effective compensation region closer to plug contacts 56, which may result in higher electrical performance potential.

Figure 8:
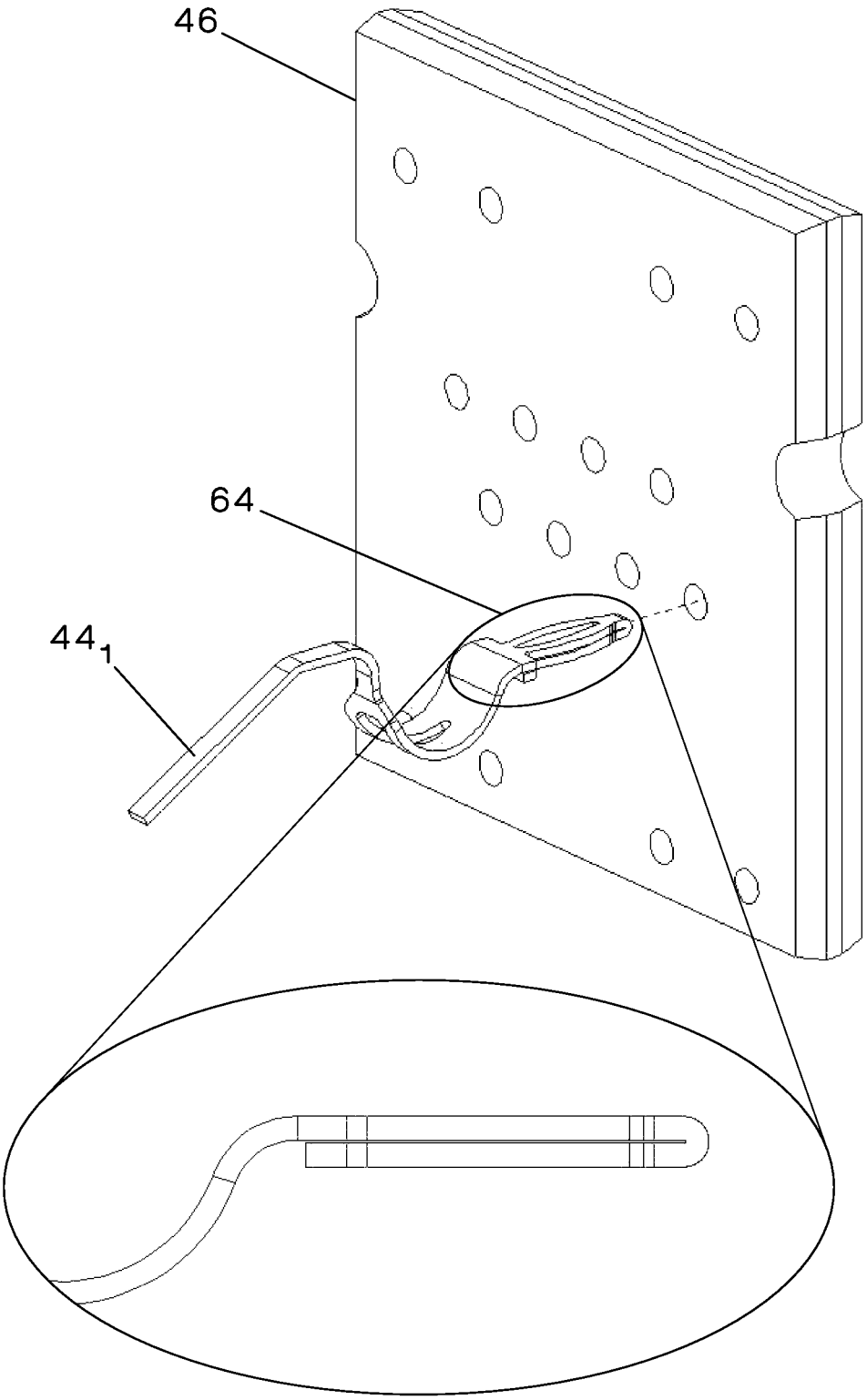
FIG. 8 illustrates the assembly of a PIC to the printed circuit board of the jack of FIG. 3.

Referring to FIG. 8, a compliant pin 64 is used on PIC $44_1$ to provide a mechanical retention as well as an electrical bond between the PIC $44_1$ and the PCB 46. Compliant pin 64 has an "eye of the needle" shape, having an elongated oval slit, and is hemmed back upon itself to effectively double the material thickness as shown in the detail view of FIG. 8. PIC $44_1$ is fabricated from a sufficiently thin material to obtain the necessary deflection while not incurring plastic deformation. Hemming the compliant pin 64 may increase the strength of the hemmed region and provides a more robust interface to PCB 46. Although FIG. 8 illustrates only PIC $44_1$, the same compliant pin 64 may be used on any of the remaining PICs.

Figure 9:
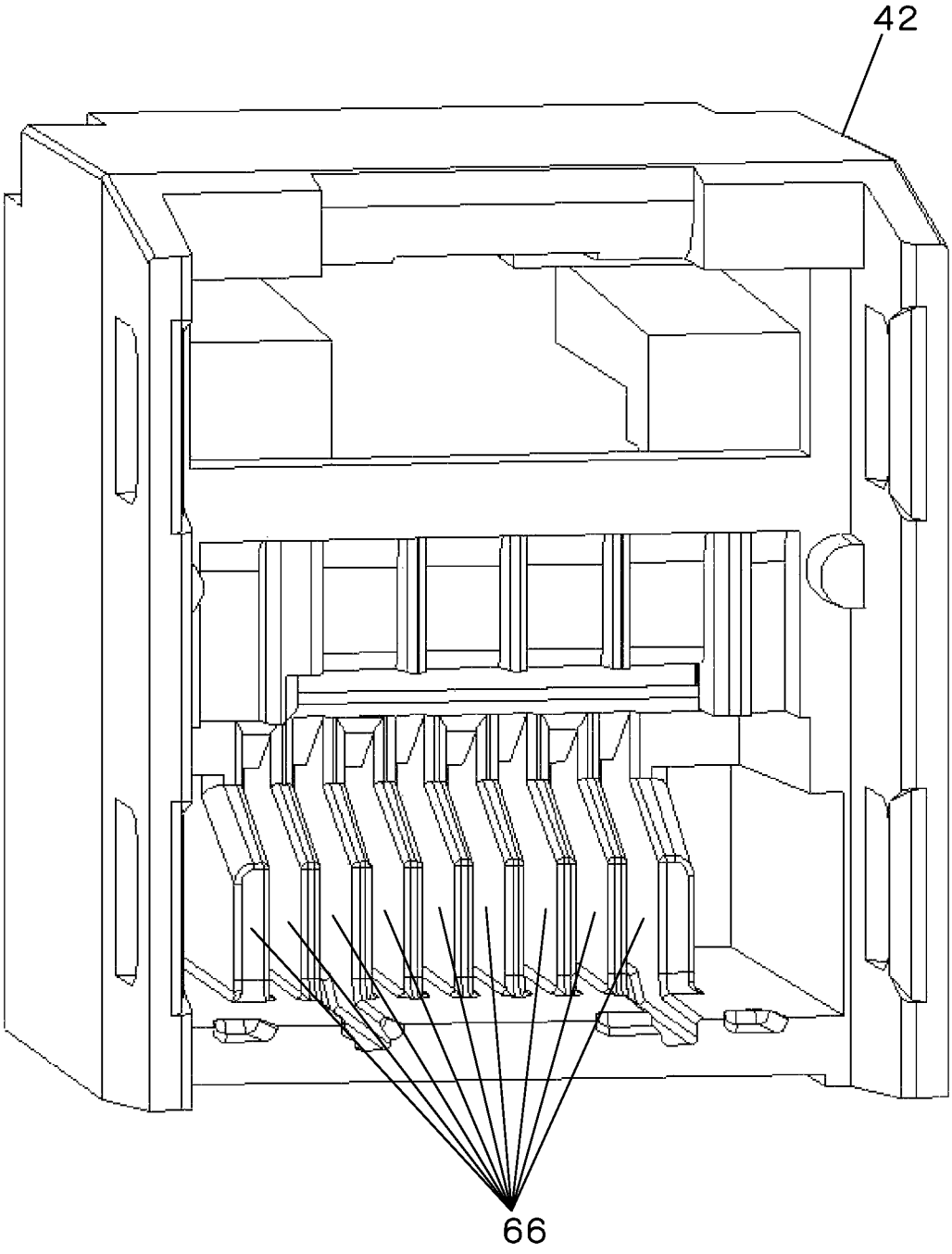
FIG. 9 illustrates a rear isometric view of the front housing of the jack of FIG. 3.
Figure 10:
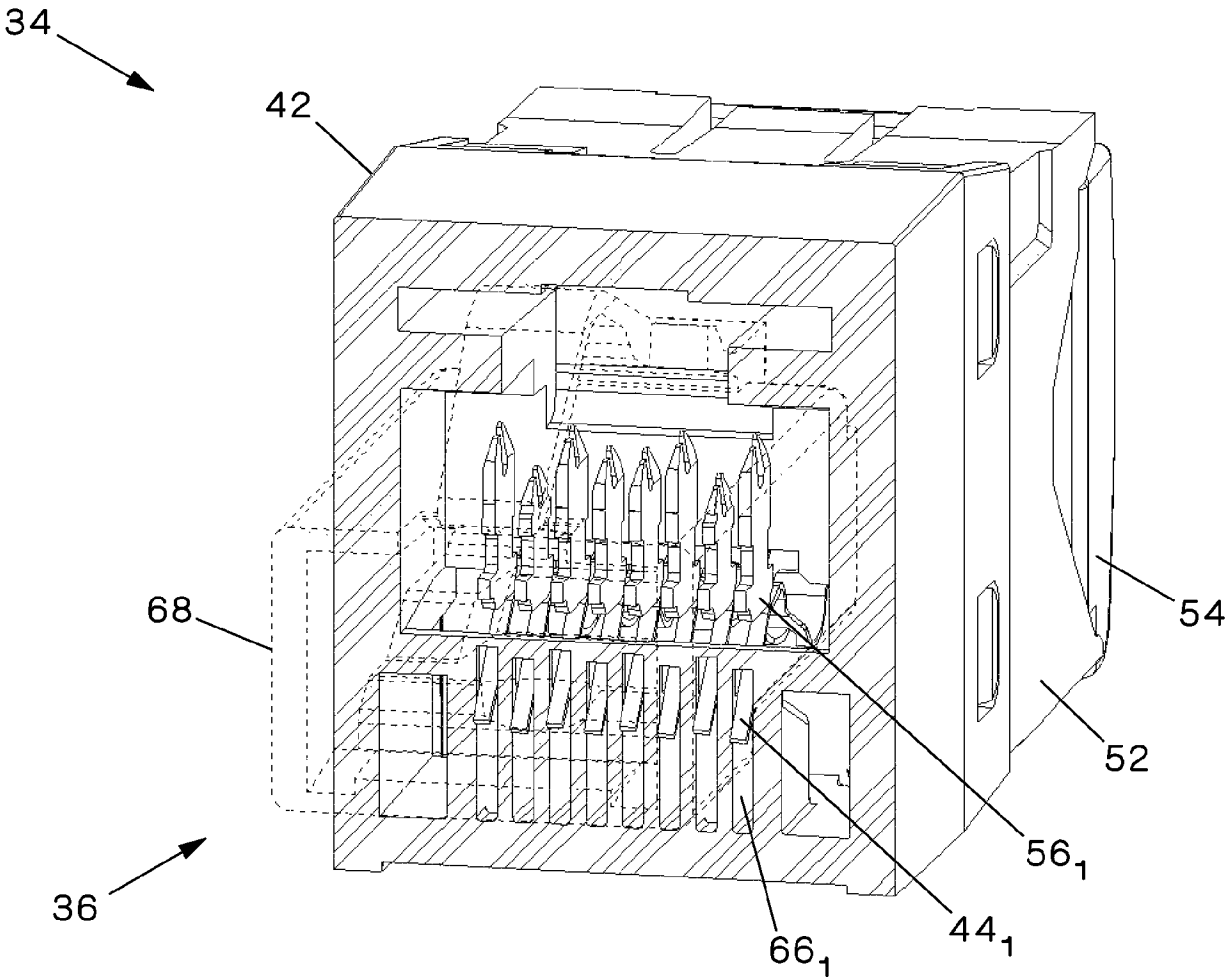
FIG. 10 illustrates a front isometric partial section view of FIG. 2.

Besides ensuring proper vertical movement and resiliency of the PICs 44, it may also be advantageous to at least partially restrain their lateral movement. FIG. 9 illustrates a rear isometric view of the front housing 42. Front combs 66 are integrated into the front housing 42 to control the relative spacing among PICs 44 and prevent PICs 44 from crossing, electrically shorting, and/or getting sufficiently close to one another where a hipot failure can occur. Front combs 66 are large enough to ensure that PICs 44 are combed during the entire state of deflection, including solid plug insertion if a four or six position plug is inserted. FIG. 10 illustrates the deflection of the PICs 44 during normal operation via a front isometric partial section view of FIG. 2. In this figure, an exemplary RJ45 plug housing 68 is shown in dashed lines for clarity. When an RJ45 plug 36 is inserted into the network jack 34, plug contacts 56 interface with PICs 44 as shown. PICs 44 deflect downward within front combs 66 and create pressure at the interface between respective plug contacts 56 and PICs 44, resulting in an electrical bond sufficient for data to flow.

Figure 11:
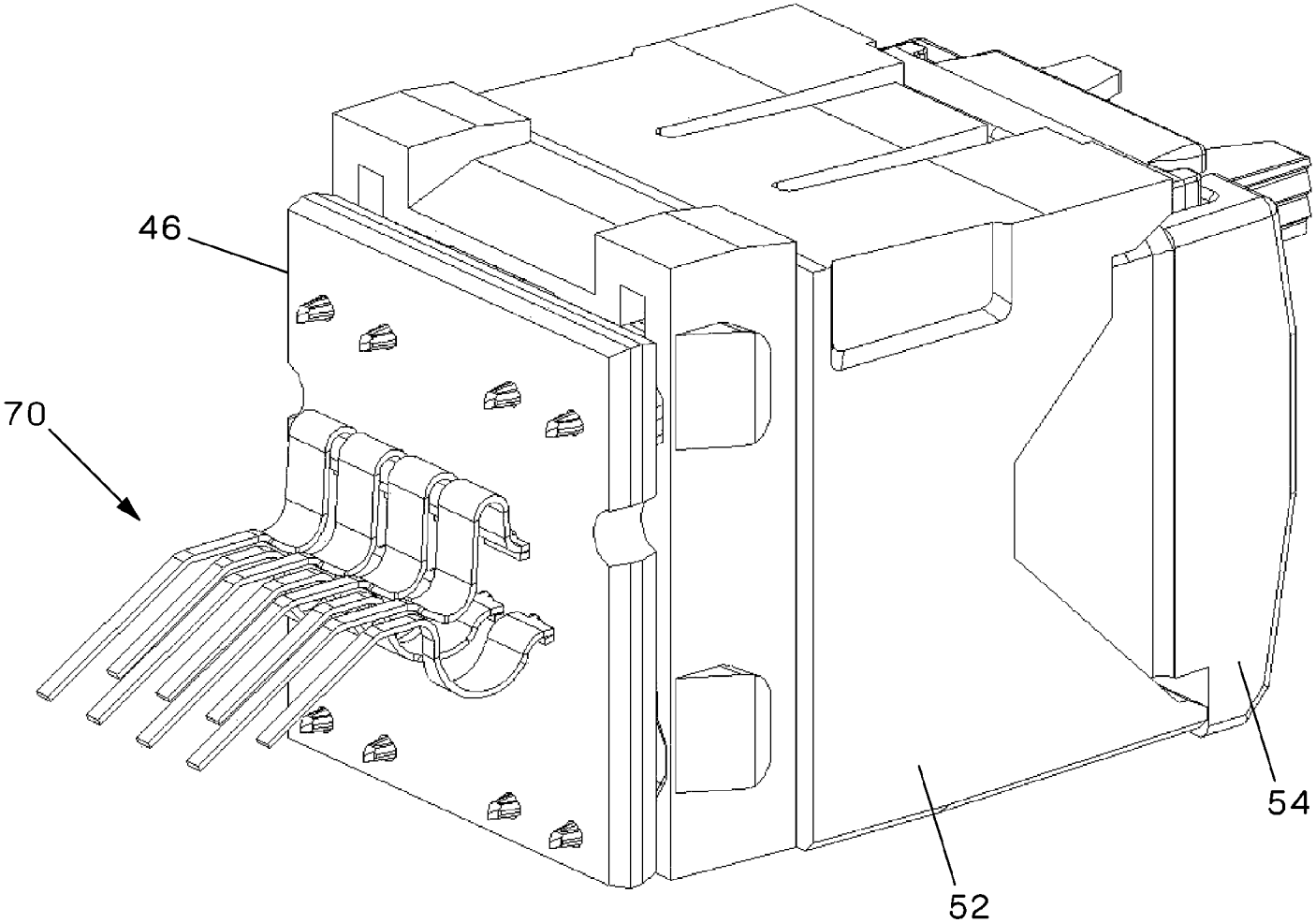
FIG. 11 illustrates a jack having a PIC arrangement/form according to another embodiment of the present invention.
Figure 12:
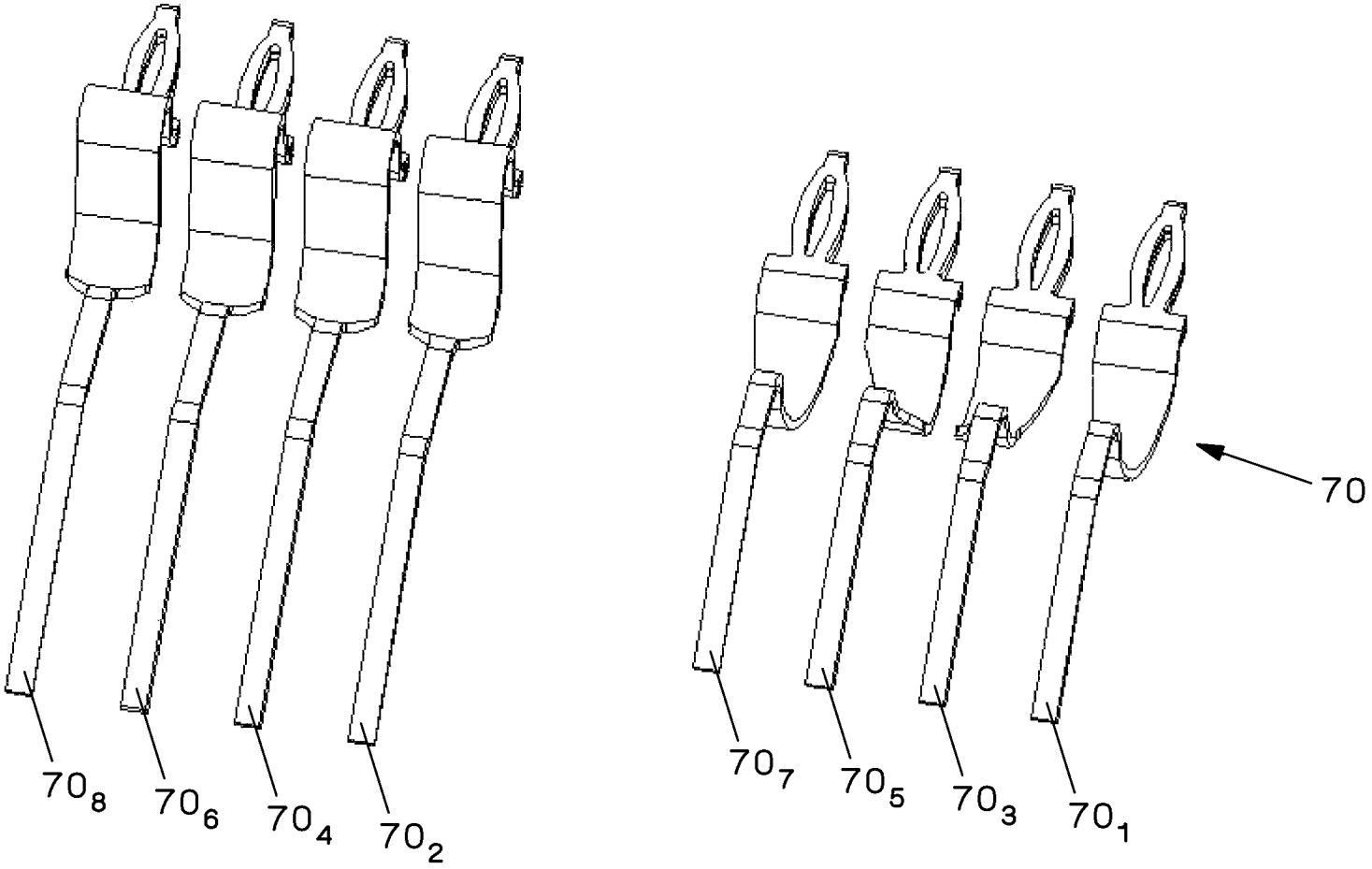
FIG. 12 illustrates the PICs of the jack of FIG. 11.

A variation of the currently described embodiment of the network jack 34 and its PICs is shown in FIGS. 11 and 12. FIG. 11 illustrates the alternate PICs 70 assembled to PCB 46, and FIG. 12 illustrates the alternate PICs 70 individually. As seen in these figures, PICs 70 do not contain pockets 60. Instead, at least in some cases, the cross-sectional width is varied by adjusting the overall width of the respective PICs as measured from one side to the other. The omission of pockets may simplify the manufacture of PICs 70 while still providing a similar effect of distributing bending stresses over the deflection zone and reducing plastic deformation.

Figure 13:
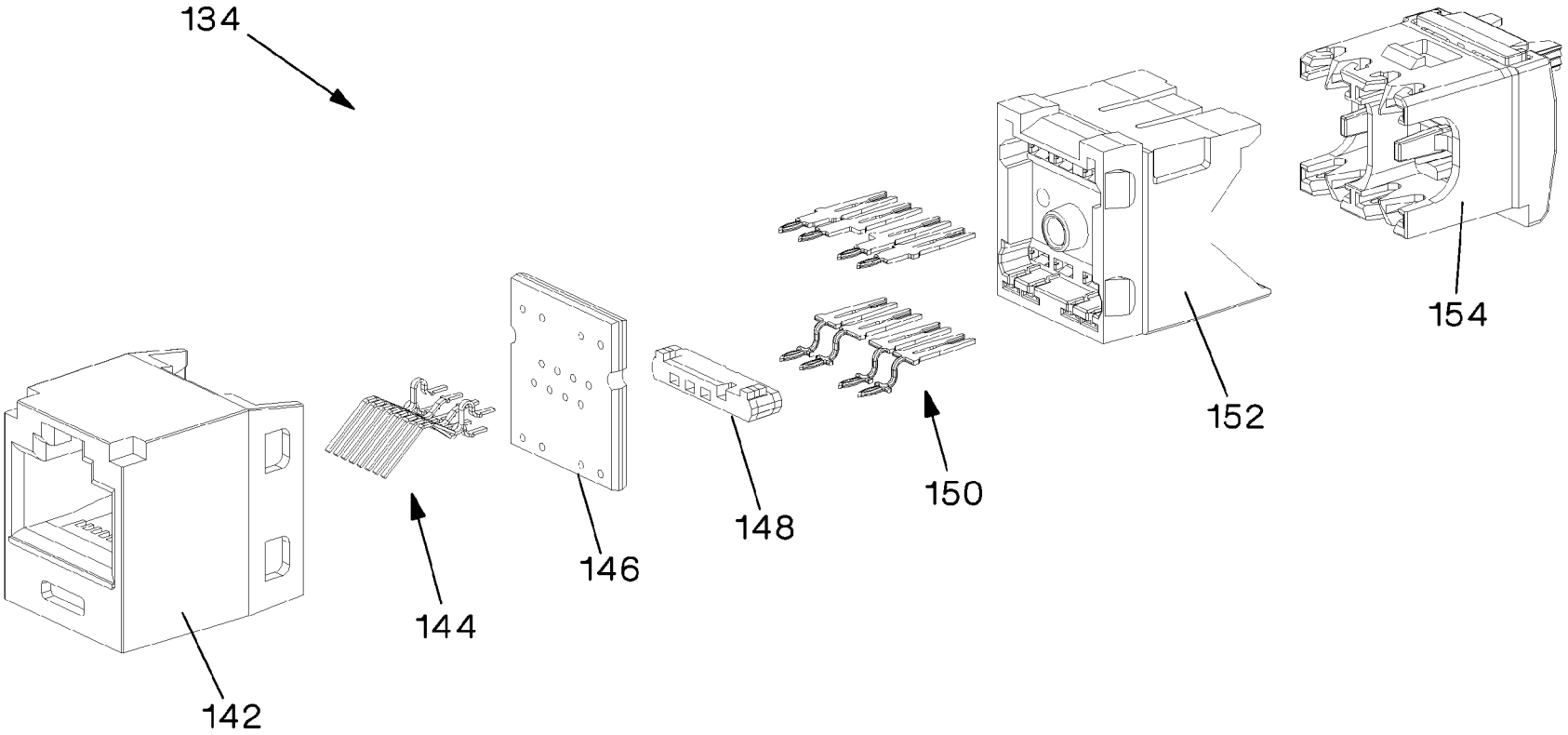
FIG. 13 illustrates an exploded view of a communication jack according to yet another embodiment of the present invention.

Another embodiment of a jack having PICs in accordance with an embodiment of the present invention is shown in FIG. 13. This figure shows an exploded view of a jack 134, which includes a front housing 142, back-rotated PICs 144, a PCB 146 (which in some embodiments may have crosstalk compensation components thereon), an IDC support 148, IDCs 150, a rear housing 152, and a wire cap 154.

Figure 14:
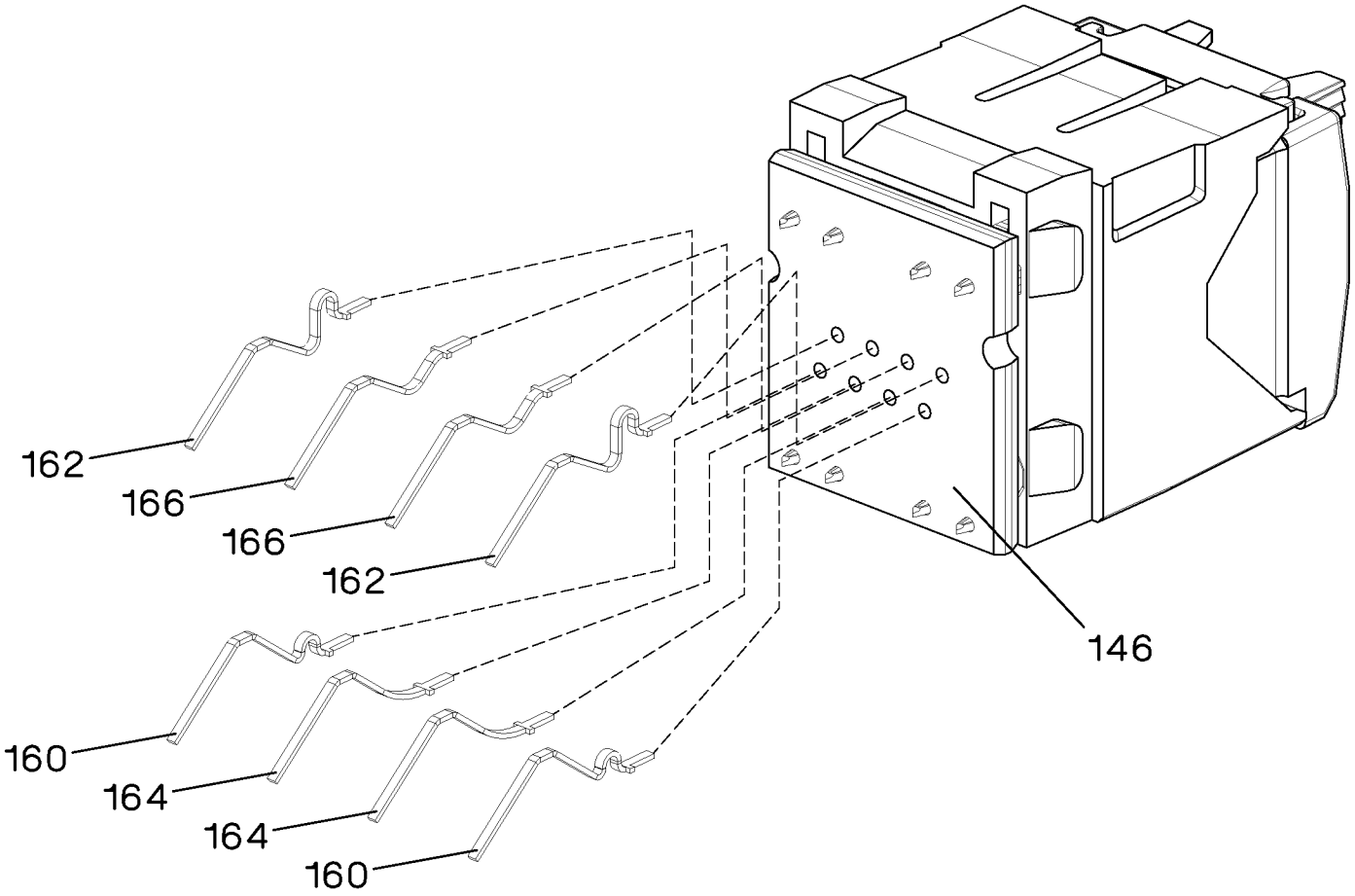
FIG. 14 illustrates the jack of FIG. 13 with the front housing removed and the PICs exploded.
Figure 15:
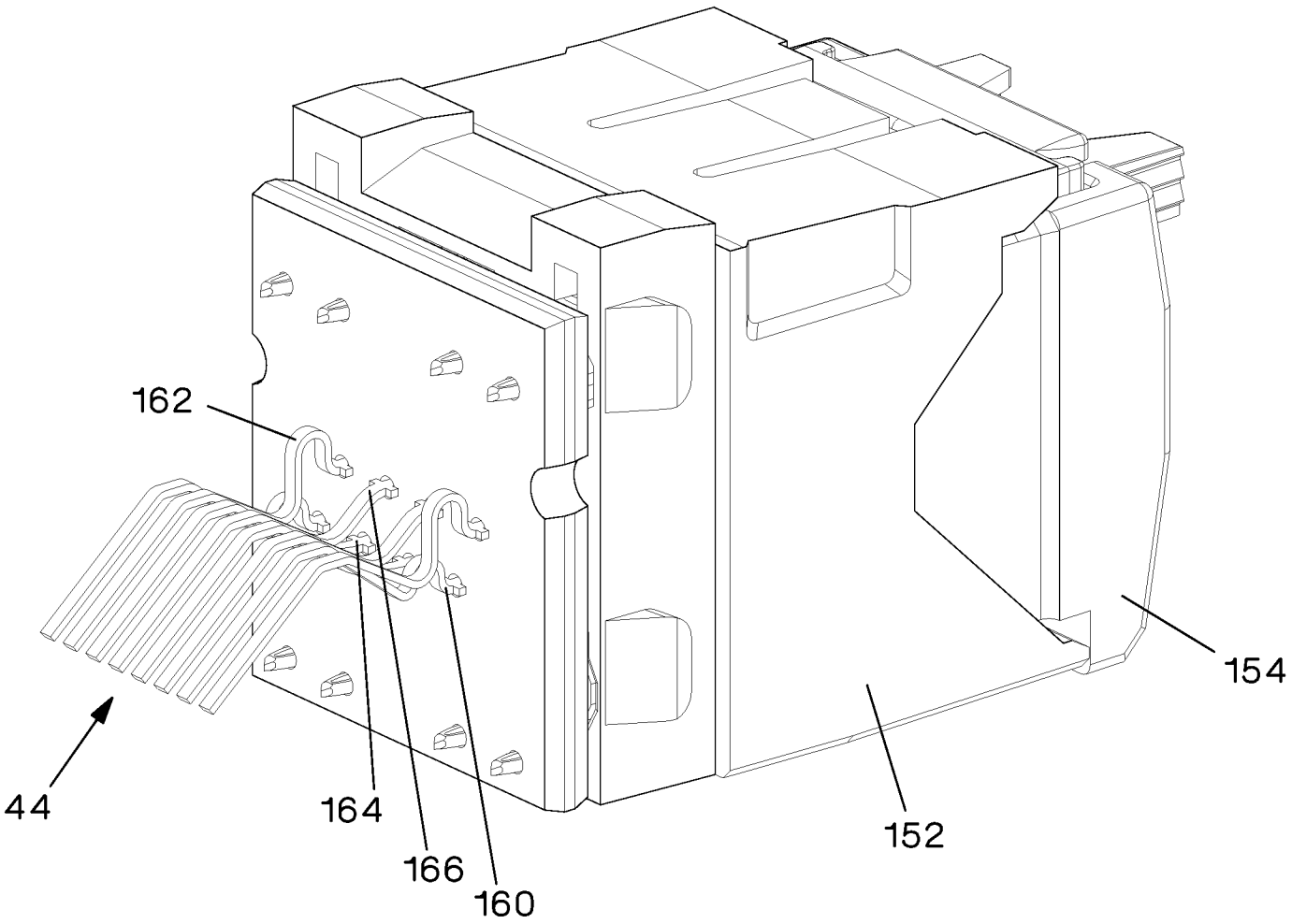
FIG. 15 illustrates the jack of FIG. 13 with the front housing removed.
Figure 16:
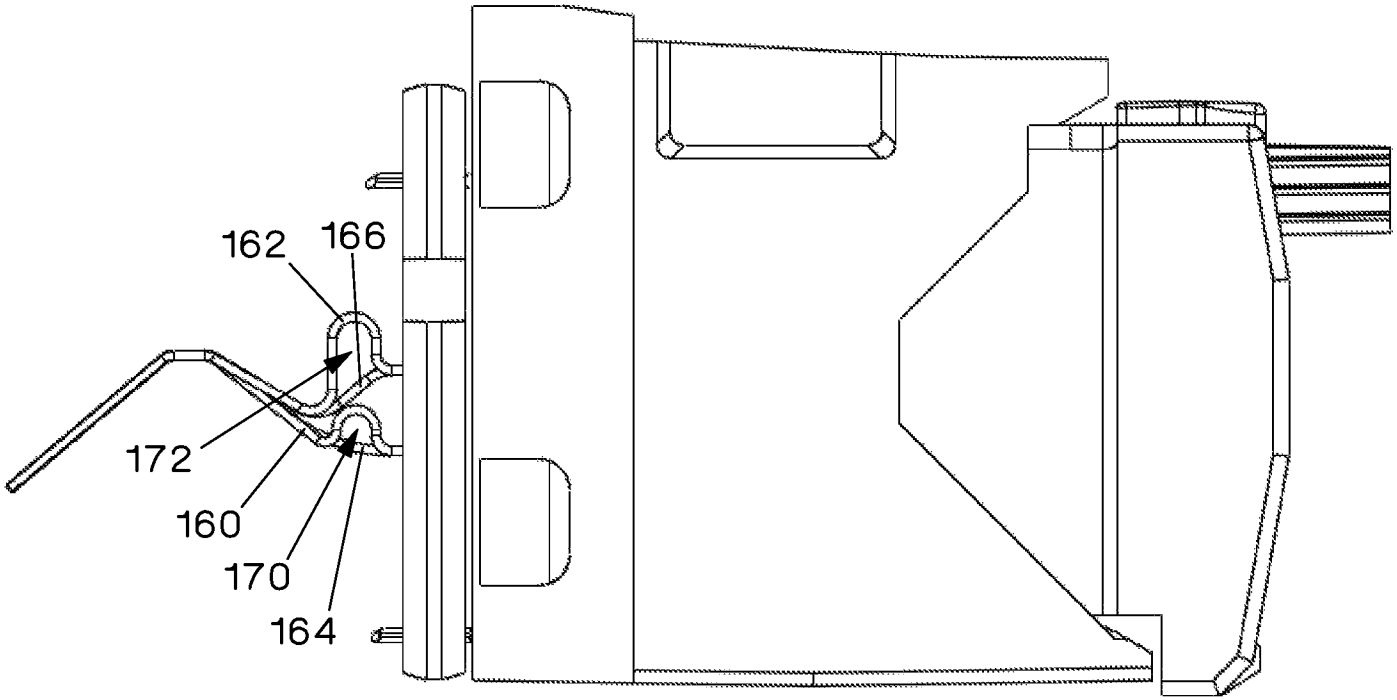
FIG. 16 illustrates a side vide of FIG. 15.

As shown more clearly in the perspective views illustrated in FIGS. 14 and 15, and the side profile view illustrated in FIG. 16, the PICs 144 are comprised of four different types of PICs 160, 162, 162, and 164. These PICs 144 are attached to a PCB 146 via a top and bottom row. The top row includes PICs 162 and 166, and the bottom row includes PICs 160 and 164.

As shown in FIG. 16, PICs 160 and 162 include downward-facing concave loops 170 and 172, respectively, positioned near the point of attachment to the PCB (which is also the pivot point for the PICs when said PICs are deflected during mating). These loops 170 and 172 may increase the mechanical performance of the jack 134. In particular, when the jack 134 is mated with an eight-position plug, PICs 160 interface plug contacts 2 and 8, PICs 162 interface plug contacts 1 and 7, PICs 164 interface with plug contacts 4 and 6, and PICs 166 interface plug contacts 3 and 5. However, when the jack 134 is mated with a four-position plug, PICs 160 and 162 make contact with the plug body and are subject to a higher degree of deformation than PICs 164 and 166 which mate with plug contacts 1, 2, 3 and 4. Loops 170 and 172 provide PICs 160 and 162 with an increased beam length, which helps accommodate the additional displacement and also helps provide the necessary normal force to potentially prevent at least some plastic deformation. Similar benefits can be realized during the insertion of a six-position plug which causes the outer-most PICs to undergo the greatest degree of deflection.

Since PICs 164 and 166 are not expected to withstand the same degree deflection as PICs 160 and 162, their beams length can be shorter than the beam length of PICs 160 and 162. The shorter beam length may simplify the manufacturing process and may also improve the electrical performance of the jack 134 as it may help bring any crosstalk compensation components which may be present on the PCB 146 closer to the origin of any offending crosstalk.

Note that while this invention has been described in terms of several embodiments, these embodiments are non-limiting (regardless of whether they have been labeled as exemplary or not), and there are alterations, permutations, and equivalents, which fall within the scope of this invention. Furthermore, the described embodiments should not be interpreted as mutually exclusive, and should instead be understood as potentially combinable if such combinations are permissive. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. A plug interface contact (PIC) for use in an RJ45-compatible communication jack having a printed circuit board (PCB), said PIC comprising:

a first end;

a second end, at least a portion of at least one of said first end and said second end being electrically and mechanically connected to said PCB; and an intermediate region positioned between said first end and said second end, said intermediate region having a thickness that is different from a thickness of said end electrically and mechanically connected to said PCB.

2. The PIC of claim 1, wherein at least one of said first end and said second end comprises a compliant pin.

3. The PIC of claim 1, wherein said thickness of said intermediate region is one-half of the thickness of at least one of said first end and said second end.

4. The PIC of claim 1, wherein at least one of said first end and said second end is hemmed.

5. The PIC of claim 1, wherein said intermediate region includes a single-layer construction, and wherein said at least one of said first end and said second end includes a multi-layer construction.

6. The PIC of claim 5, wherein said multi-layer construction is a two-layer construction.

7. The PIC of claim 1, wherein said intermediate region includes a contact region configured to make contact with a plug contact of a communication plug.

8. An RJ45-compatible communication jack comprising:

a housing;

a printed circuit board (PCB) positioned at least partially within said housing; and a plurality of plug interface contacts (PICs), each of said PICs including:

a fixed end fixed within said PCB;

a free end that is opposite of said fixed end; and an intermediate region positioned between said fixed end and said free end, said fixed end having a thickness that is greater than a thickness of at least one of said free end and said intermediate region.

9. The communication jack of claim 8, wherein said thickness of said free end is the same as said thickness of said intermediate region.

10. The communication jack of claim 8, wherein said fixed end comprises a compliant pin.

11. The communication jack of claim 8, wherein said fixed end is hemmed.

12. The communication jack of claim 8, wherein said thickness of said fixed end is twice said thickness of at least one of said free end and said intermediate region.

13. The communication jack of claim 8, wherein at least one of said free end and said intermediate region includes a single-layer construction, and wherein said fixed end includes a multi-layer construction.

14. The communication jack of claim 8, wherein said multi-layer construction is a two-layer construction.

15. The communication jack of claim 8, wherein said intermediate region includes a contact region configured to make contact with a plug contact of a communication plug.

16. A plug interface contact (PIC) for use in an RJ45-compatible communication jack having a printed circuit board (PCB), said PIC comprising:

a first end;

a second end; and an intermediate region positioned between said first end and said second end, said intermediate region having a single layer of a material, and at least one of said first end and said second end having multiple layers of said material and being fixed within said PCB.

17. The PIC of claim 16, wherein said multiple layers are two layers.

18. The PIC of claim 16, wherein one of said first end and said second end comprises a compliant pin.

19. The PIC of claim 16, wherein one of said first end and said second end is hemmed.

20. The PIC of claim 16, wherein said intermediate region includes a contact region configured to make contact with a plug contact of a communication plug.

* * * * *